US010260701B2

(12) United States Patent
Na et al.

(10) Patent No.: US 10,260,701 B2
(45) Date of Patent: Apr. 16, 2019

(54) LIGHT MODULE FOR VEHICLE WITH A SCANNING REFLECTOR AND AN OPTICAL ELEMENT THAT CONDENSES THE CENTER OF THE LIGHT DISTRIBUTION AND SPREADS THE OUTER PORTION OF THE LIGHT DISTRIBUTION

(71) Applicant: Hyundai Motor Company, Seoul (KR)

(72) Inventors: Jin Ho Na, Yongin-si (KR); Byoung Suk Ahn, Gwacheon-si (KR)

(73) Assignee: Hyundai Motor Company, Seoul (KR)

( * ) Notice: Subject to any disclaimer, the term of this patent is extended or adjusted under 35 U.S.C. 154(b) by 83 days.

(21) Appl. No.: 15/342,062

(22) Filed: Nov. 2, 2016

(65) Prior Publication Data

US 2017/0370549 A1 Dec. 28, 2017

(30) Foreign Application Priority Data

Jun. 27, 2016 (KR) ..... 10-2016-0080083

(51) Int. Cl.

| | |
|---|---|
| ***F21S 41/675*** | (2018.01) |
| ***F21S 41/32*** | (2018.01) |
| ***F21S 41/16*** | (2018.01) |
| ***F21S 41/365*** | (2018.01) |

(52) U.S. Cl.

CPC ..... *F21S 41/675* (2018.01); *F21S 41/16* (2018.01); *F21S 41/32* (2018.01); *F21S 41/365* (2018.01)

(58) Field of Classification Search

CPC ..... F21S 41/675; F21S 41/365; F21S 41/16; F21S 41/32

See application file for complete search history.

(56) References Cited

U.S. PATENT DOCUMENTS

2011/0205744 A1* 8/2011 Kim ..... F21V 5/04 362/296.01
2013/0094235 A1* 4/2013 Sugiyama ..... F21S 48/1757 362/514
2014/0085919 A1* 3/2014 Tsai ..... F21V 5/08 362/522

(Continued)

FOREIGN PATENT DOCUMENTS

JP 2014-058204 A 4/2014
JP 2015-184591 A 10/2015
JP 2016-011039 A 1/2016

(Continued)

OTHER PUBLICATIONS

Yagi, Headlamp for vehicle, Sep. 28, 2017; Patent Pub WO2017164327A1; Google Patents, htts://patents.google.com/patent/WO2017164327A1/en?.*

*Primary Examiner* — Anh T Mai
*Assistant Examiner* — Michael Chiang
(74) *Attorney, Agent, or Firm* — Morgan, Lewis & Bockius LLP

(57) ABSTRACT

A light module for a vehicle may include a light source generating light, a variable mirror generating an image depending on the light by reflecting the light generated by the light source, and an optical receiving the light reflected by the variable mirror, the optical having a continuously curved shape in a left-and-right direction for light introduced into a center of the optical to be condensed and moved and light introduced into a side of the optical to be diffused and moved.

12 Claims, 8 Drawing Sheets

(56) References Cited

U.S. PATENT DOCUMENTS

| | | | | |
|---|---|---|---|---|
| 2017/0138555 | A1* | 5/2017 | Hirasawa | B60Q 1/14 |
| 2018/0128442 | A1* | 5/2018 | Suwa | F21S 41/32 |

FOREIGN PATENT DOCUMENTS

| | | | | |
|---|---|---|---|---|
| JP | WO 2017164327 | A1 * | 9/2017 | F21S 43/00 |
| KR | 10-2001-0051437 | A | 6/2001 | |
| KR | 10-1047439 | | 7/2011 | |
| KR | 10-2015-0010301 | | 1/2015 | |
| KR | 10-2015-0044651 | | 4/2015 | |
| KR | 10-2016-0069083 | | 6/2016 | |

* cited by examiner

LIGHT MODULE FOR VEHICLE WITH A SCANNING REFLECTOR AND AN OPTICAL ELEMENT THAT CONDENSES THE CENTER OF THE LIGHT DISTRIBUTION AND SPREADS THE OUTER PORTION OF THE LIGHT DISTRIBUTION

CROSS-REFERENCE TO RELATED APPLICATION

The present application claims priority to Korean Patent Application No. 10-2016-0080083, filed Jun. 27, 2016, the entire contents of which is incorporated herein for all purposes by this reference.

BACKGROUND OF THE INVENTION

Field of the Invention

The present invention relates to a light module for a vehicle, which achieves improved luminance efficiency of beam scanning.

Description of Related Art

Generally, a vehicle is provided with a lighting apparatus, which serves to assist a driver in clearly viewing objects in a driving direction at night, and to notify other vehicles or persons on the road of the state of driving of the owner's vehicle.

In addition to simply emitting light, in recent years, a technology of projecting a specific image to increase the driver's convenience and various other functions have been added to the lighting apparatus.

In order to realize beam scanning of the lighting apparatus, laser scanning devices using a polygon mirror and a galvanometer mirror have been applied. However, the polygon mirror and the galvanometer mirror are plagued with problems related to size reduction and high prices.

Therefore, a beam scanning device using a Micro Electro Mechanical System (MEMS) mirror is used. The beam scanning device using the MEMS mirror advantageously exhibits low power consumption and may be reduced in size.

However, the MEMS mirror vibrates in the left-and-right direction during laser beam scanning using the MEMS mirror, causing deterioration in the brightness of the central portion compared to the edge portion. That is, because the light reflected by the MEMS mirror shows a pattern of motion from the upper side to the lower side in the left-and-right direction, laser beams overlap each other in the edge portion in the left-and-right direction, which causes deterioration in the brightness of the central portion compared to the edge portion.

Because a headlamp requires the highest brightness in the central portion, this deterioration in the brightness of the central portion results in deterioration in the luminance efficiency of the headlamp.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a light module for a vehicle, which achieves improved luminance efficiency by preventing the brightness of the central portion from being deteriorated compared to that in the edge portion during laser beam scanning using an MEMS mirror, and increasing the brightness of the central portion.

According to various aspects of the present invention, a light module for a vehicle may include a light source generating light, a variable mirror generating an image depending on the light by reflecting the light generated by the light source, and an optical receiving the light reflected by the variable mirror, the optical having a continuously curved shape in a left-and-right direction for light introduced into a center of the optical to be condensed and moved and light introduced into a side of the optical to be diffused and moved.

The variable mirror may be a Micro Electro Mechanical System (MEMS) mirror disposed at a position, to which the light generated by the light source is introduced, to generate an image by varying an angle of reflection of the light.

The variable mirror may repeatedly vibrate in an upper-and-lower direction and the left-and-right direction, for scanning of an image depending on the light generated by the light source.

When the variable mirror vibrates in the left-and-right direction, the reflected light may vibrate at a higher speed at a position at which the light is introduced to the side of the optical than at a position at which the light is introduced to the center of the optical.

The optical may include a condenser lens portion centrally located in the left-and-right direction to condense and pass light therethrough, and a diffuser lens portion extending from the condenser lens portion to left and right sides to diffuse and pass light therethrough.

The condenser lens portion of the optical may be formed to convexly protrude, and the diffuser lens portion may be formed to be concavely indented.

The optical may be formed to convexly protrude in an upper-and-lower direction.

The optical may be formed so that the center thereof convexly protrudes and upper and lower sides thereof are concavely indented in an upper-and-lower direction.

The optical may include a condenser-reflector portion centrally located in the left-and-right direction to condense and reflect the light, and a diffuser-reflector portion extending from the condenser-reflector portion to left and right sides to diffuse and reflect the light.

The condenser-reflector portion of the optical may be formed to be concavely indented, and the diffuser-reflector portion may be formed to convexly protrude.

The optical may be formed to be concavely indented in an upper-and-lower direction.

The optical may be formed so that the center of the optical is concavely indented and upper and lower sides thereof convexly protrude in an upper-and-lower direction.

The light module may further include a light-emitter provided at a position to which the light, condensed and diffused by the optical, is introduced for the introduced light to be emitted in a colored state.

The light source may include a plurality of light sources which emit light toward the variable mirror at different positions.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
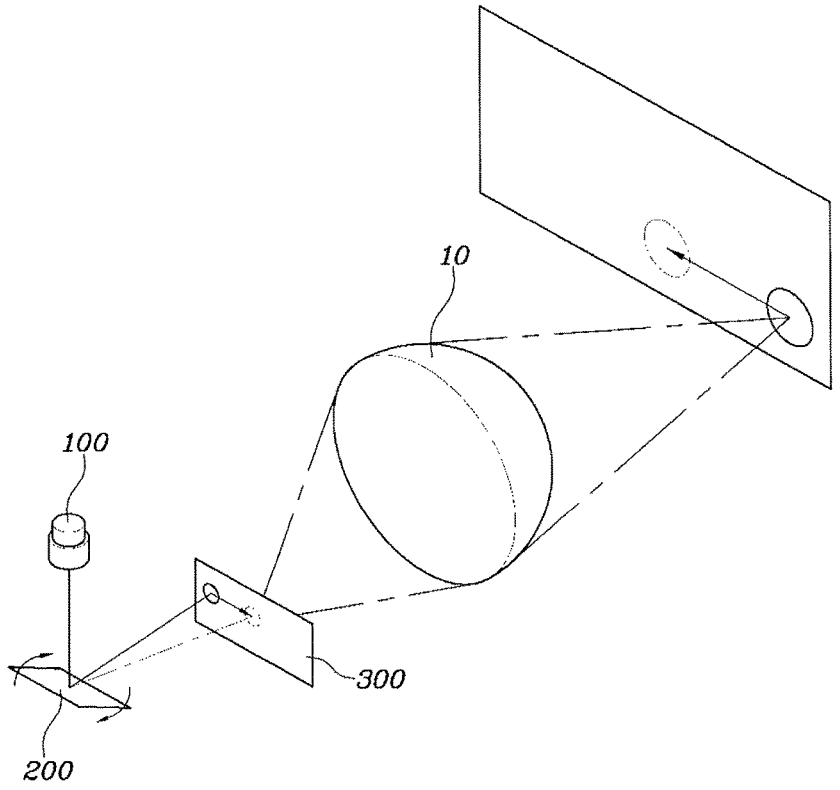
FIG. 1 is a view illustrating a light module for a vehicle according to various embodiments of the present invention.

FIG. 1 is a view illustrating a light module for a vehicle according to various embodiments of the present invention.

Figure 2:
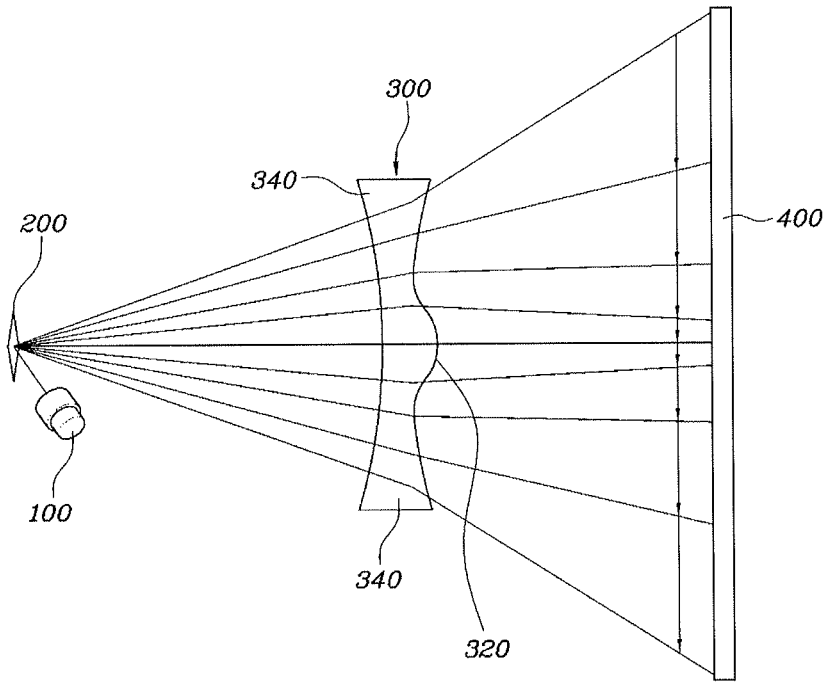
FIG. 2 is a view illustrating an optical in the light module for the vehicle according to various embodiments of the present invention.
Figure 3:
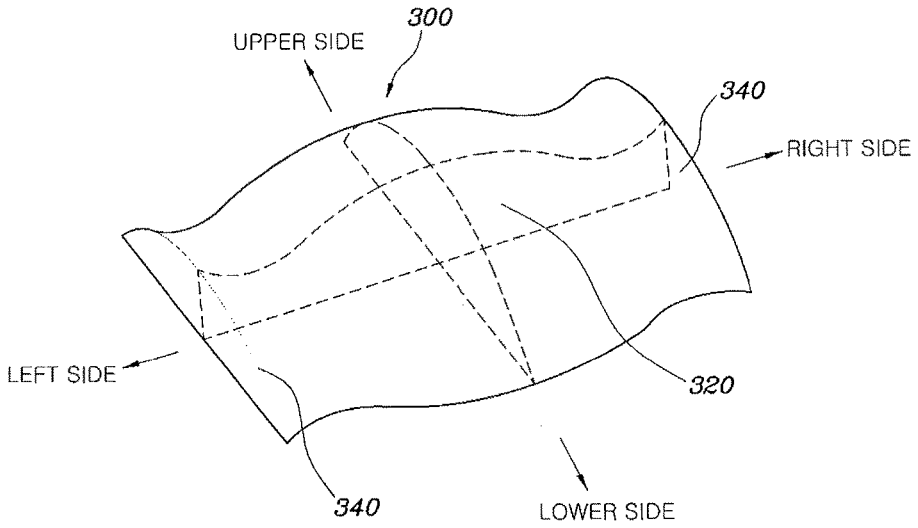
FIG. 3 and FIG. 4 are views for the explanation of the light module for the vehicle illustrated in FIG. 2.
Figure 4:
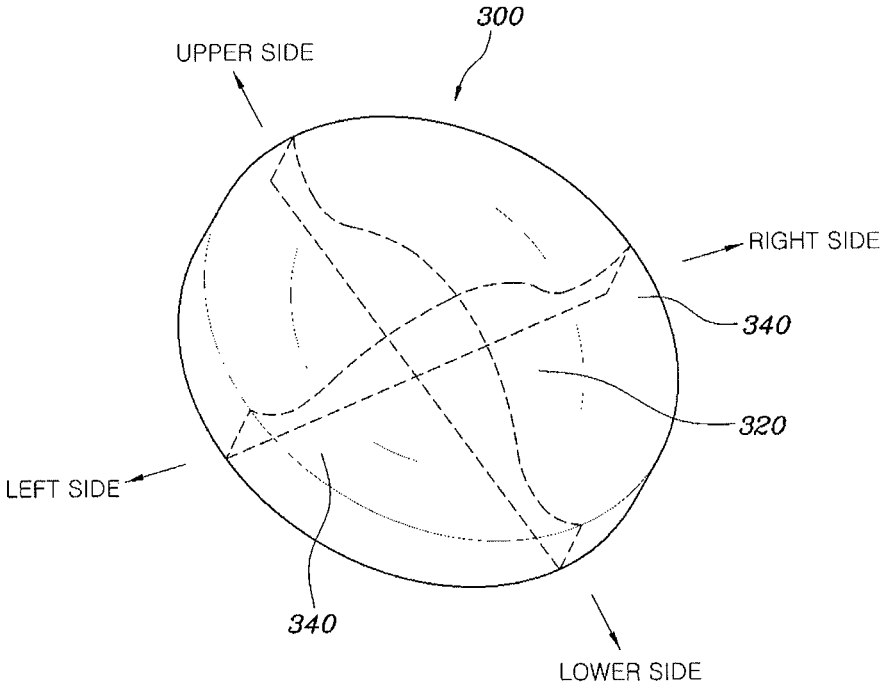

FIG. 2 is a view illustrating an optical in the light module for the vehicle according to various embodiments of the present invention, and FIGS. 3 and 4 are views for the explanation of the light module for the vehicle illustrated in FIG. 2.

Figure 5:
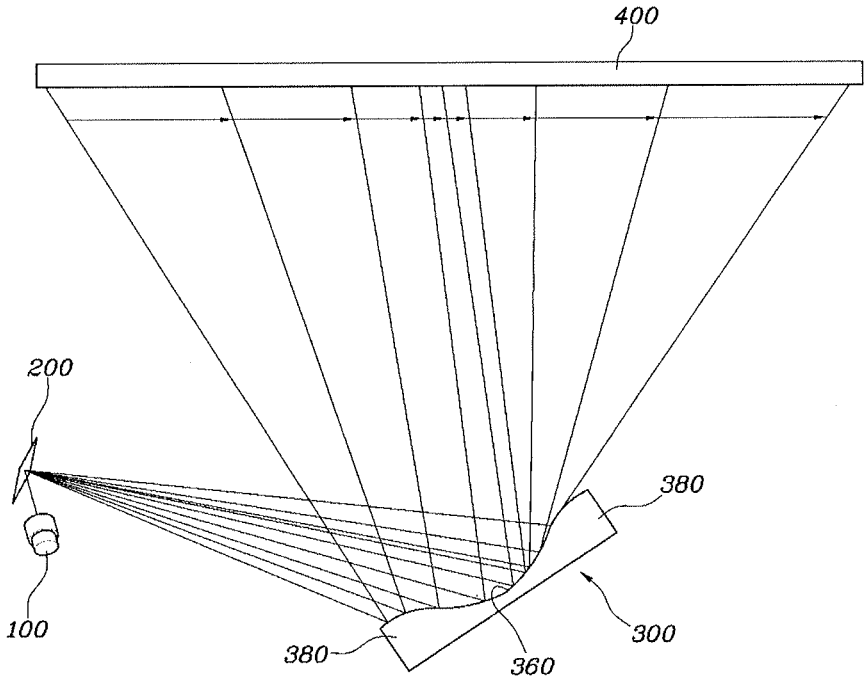
FIG. 5 is a view illustrating an optical in the light module for the vehicle according to various embodiments of the present invention.
Figure 6:
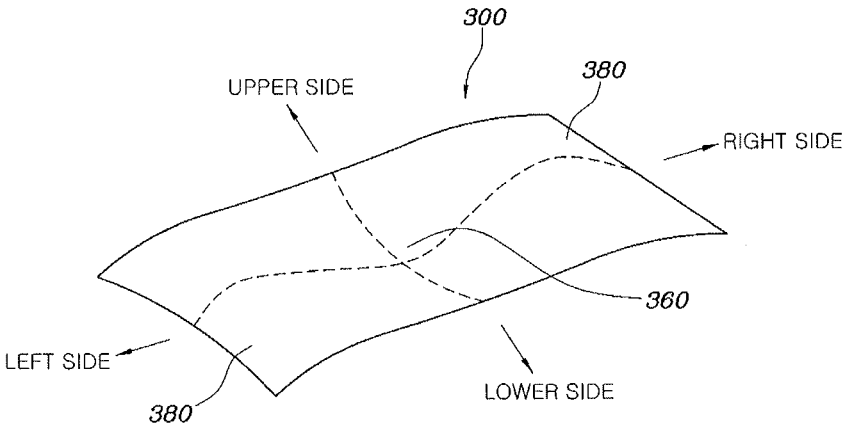
FIG. 6 and FIG. 7 are views illustrating the light module for the vehicle illustrated in FIG. 5.
Figure 7:
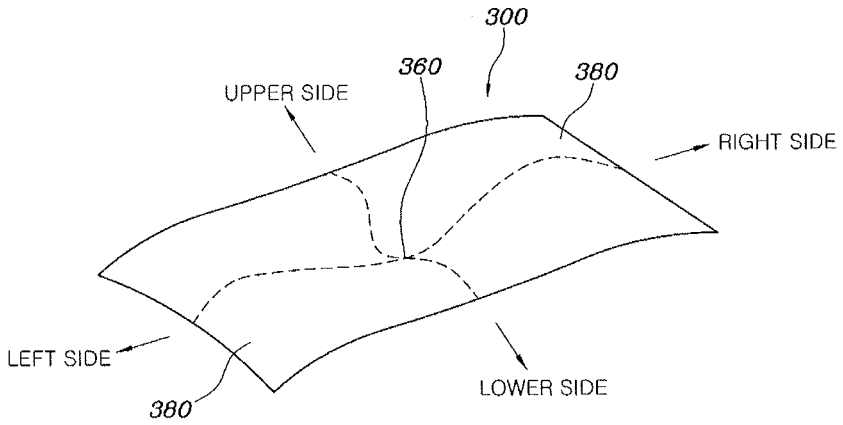
Figure 8:
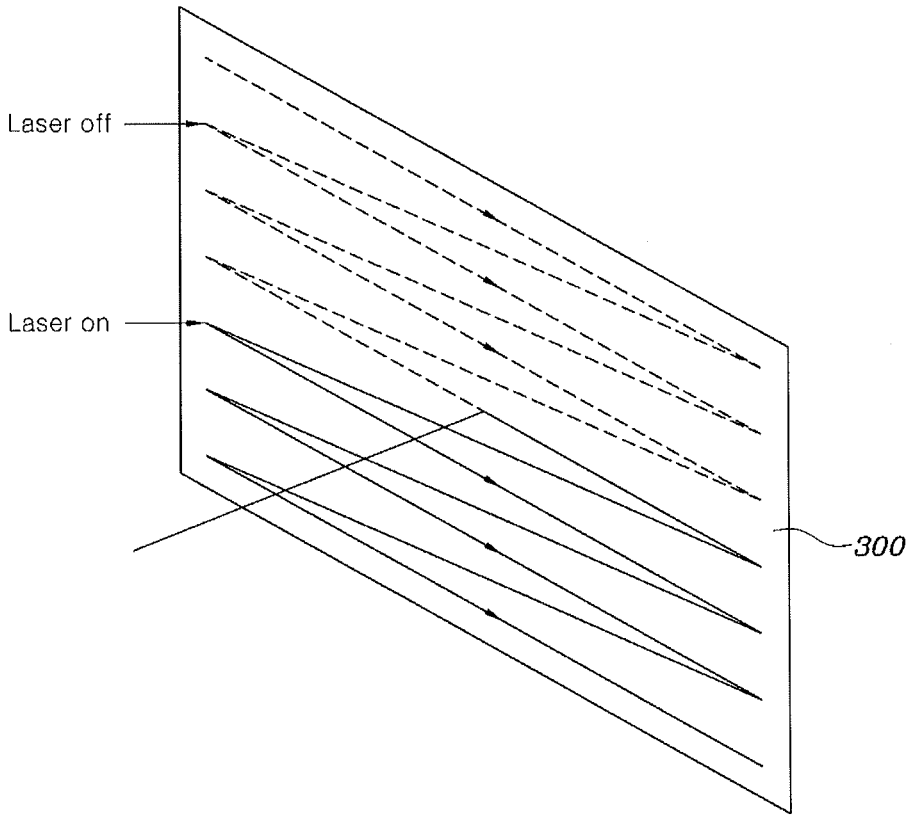
FIG. 8 is a view illustrating a variable mirror in the light module for the vehicle according to the present invention.

FIG. 5 is a view illustrating an optical in the light module for the vehicle according to various embodiments of the present invention, and FIGS. 6 and 7 are views for the explanation of the light module for the vehicle illustrated in FIG. 5. FIG. 8 is a view for illustrating a variable mirror in the light module for the vehicle according to various embodiments of the present invention.

The light module for the vehicle according to the present invention, as illustrated in FIG. 1, includes a light source 100 for generating light, a variable mirror 200 for generating an image depending on the light by reflecting the light generated by the light source 100, and optical 300 for receiving the light reflected by the variable mirror 200, the optical 300 having a continuously curved shape in the left-and-right direction so that light introduced into the center thereof is condensed and moved and the light introduced into the side thereof is diffused and moved. Further, the light module includes a light-emitter 400 provided at the position to which the light, condensed and diffused by the optical 300, is introduced to cause the introduced light to be emitted in a colored state.

Here, LEDs may be applied as the light source 100, and the variable mirror 200 may be configured as a Micro Electro Mechanical System (MEMS) mirror, which is provided at the position, to which the light generated by the light source 100 is introduced, and functions to generate an image by varying the angle of reflection of the light. The variable mirror 200 is configured to repeatedly vibrate in the upper-and-lower direction and the left-and-right direction, thereby enabling the scanning of an image depending on the light generated by the light source 100. That is, image scanning is implemented as laser beams, emitted from the light source 100, i.e. the LEDs, are repeatedly moved from the upper side to the lower side in the left-and-right direction by the variable mirror 200, the angle of reflection of which continuously varies. This image scanning technology using the light source 100 and the variable mirror 200 is already well known, and a detailed description thereof will be omitted herein.

Through the use of the light source 100 and the variable mirror 200, the present invention is devised to prevent deterioration in the brightness of the central portion compared to that in the edge portion caused when laser beams overlap each other in the edge portion in the left-and-right direction during image scanning. The optical 300 is provided at the position to which the light reflected by the variable mirror 200 is introduced, and has a continuously curved shape in the left-and-right direction. As such, the optical 300 causes the light, introduced into the center thereof, to be condensed and moved, and the light, introduced into the side thereof, to be diffused and moved. As the light, introduced into the center of the optical 300, is condensed and moved, the central portion exhibits higher brightness than the edge portion during beam scanning. In addition, as the light, introduced into the side of the optical 300, is diffused and moved, the edge portion undergoes deterioration in brightness compared to the central portion during beam scanning.

In this way, the light, condensed and diffused by the optical 300, may be introduced into the light-emitter 400, and the light-emitter 400 may cause a specific color of light to be emitted. Here, the light-emitter 400 includes phosphors. For example, when blue laser beams are emitted from the LEDs that constitute the light source 100, the light-emitter 400 receives the blue laser beams and causes the same to be transmitted as yellow laser beams, thereby allowing the emission of laser beams that may be recognized as white light.

In addition, the laser beams, the color of which is changed by the light-emitter 400, may be projected to the road surface after passing through a condensing lens 10.

As described above, in the present invention, because the central portion achieves higher brightness than the edge portion during beam scanning via the optical 300, the central portion of beam scanning achieves sufficient brightness without separate electronic control, which results in improved luminance efficiency.

Hereinafter, various embodiments for acquiring the brightness of the central portion of beam scanning will be described.

First, when the variable mirror 200 of the present invention vibrates in the left-and-right direction, the variable mirror 200 may cause the light reflected thereby to vibrate at a higher speed at the position at which it is introduced to the side of the optical 300 than at the position at which it is introduced to the center of the optical 300.

As described above, when the variable mirror 200 repeatedly vibrates in the left-and-right direction, the light reflected by the variable mirror 200 vibrates at a higher speed at the position at which the light is introduced to the side of the optical 300 than at the position at which the light is introduced to the center of the optical 300, whereby the brightness of the edge portion and the central portion of beam scanning may be adjusted. That is, referring to FIG. 8, although the region in which laser beams overlap each other is generated in the edge portion of beam scanning, it is possible to increase the brightness in the central portion of beam scanning compared to the edge portion by increasing the rate of angular variation at the position corresponding to the edge portion of beam scanning and reducing the rate of angular variation at the position corresponding to the central portion of beam scanning when the variable mirror 200 vibrates.

Meanwhile, according to various embodiments, as illustrated in FIGS. 2 to 4, the optical 300 may include a condenser lens portion 320, which is centrally located in the left-and-right direction and serves to condense and pass light therethrough, and a diffuser lens portion 340, which extends from the condenser lens portion 320 to the left and right sides and serves to diffuse and pass light therethrough. The optical 300 according to various embodiments may be configured as a lens for transmitting light therethrough, and may be provided at the center thereof with the condenser lens portion 320 and at opposite sides thereof with the diffuser lens portion 340.

Accordingly, the condenser lens portion 320 of the optical 300 is formed so as to convexly protrude and the diffuser lens portion 340 is formed so as to be concavely indented. Thus, when light passes through the convexly protruding condensing lens portion 320, the light may be condensed and moved. When the light passes through the concavely indented diffuser lens portion 340, the light may be diffused and moved. In this way, when the light generated by the light source 100 is reflected by the variable mirror 200, and thereafter, is introduced into the optical 300, the light passing through the condenser lens portion 320 is condensed and moved, causing increased brightness in the central portion of beam scanning, and the light passing through the diffuser lens portion 340 is diffused and moved to the edge portion of beam scanning, causing lower brightness in the edge portion than in the central portion. The condenser lens portion 320 and the diffuser lens portion 340 may be formed in the plane from which the light having passed through the optical 300 is discharged, and may extend so as to be integrally connected to each other, which may allow the light to be smoothly condensed and diffused to thereby be discharged.

Here, the optical 300, as illustrated in FIG. 3, may be formed so as to convexly protrude in the upper-and-lower direction. In addition to the concave shape of the diffuser lens portion 340 and the convex shape of the condenser lens portion 320 with respect to the left-and-right direction, when the entire optical 300 has a convex cross-section from the top to the bottom in the upper-and-lower direction, the light passing through the condenser lens portion 320 may be evenly condensed in the upper-and-lower direction. Thereby, the central portion of beam scanning achieves high brightness and the even emission of light in the upper-and-lower direction, and the edge portion of beam scanning exhibits lower brightness than the central portion.

Alternatively, as illustrated in FIG. 4, the optical 300 may be formed so that the center thereof convexly protrudes and the upper and lower sides thereof are concavely indented in the upper-and-lower direction. As such, in addition to the concave shape of the diffuser lens portion 340 and the convex shape of the condenser lens portion 320 with respect to the left-and-right direction, when the optical 300 convexly protrudes at the center thereof and is concavely indented at the upper and lower sides thereof in the upper-and-lower direction, the light may be concentrated to pass through the condenser lens portion 320 so as to be condensed. Thereby, the light is concentrated on the central portion of beam scanning, causing higher brightness in the central portion than in the edge portion of beam scanning, and causing light to be emitted at a lower brightness in the edge portion.

As described above, in the case where the optical 300 has a lens form, the curved shape of the lens in the upper-and-lower direction and in the left-and-right direction may be selectively changed by design.

Meanwhile, according to various embodiments, as illustrated in FIGS. 5 to 7, the optical 300 may include a condenser-reflector portion 360, which is centrally located in the left-and-right direction and serves to condense and reflect light, and a diffuser-reflector portion 380, which extends from the condenser-reflector portion 360 to the left and right sides and serves to diffuse and reflect light. The optical 300 according to various embodiments illustrated in FIG. 5, FIG. 6 and FIG. 7 may be formed of a mirror or a reflective medium so as to reflect light, and may be provided at the center thereof with the condenser-reflector portion 360 and at opposite sides thereof with the diffuser-reflector portion 380.

Accordingly, the condenser-reflector portion 360 of the optical 300 is formed so as to be concavely indented and the diffuser-reflector portion 380 is formed so as to convexly protrude so that light may be condensed and moved by the concavely indented condenser-reflector portion 360 and may be diffused and moved by the convexly protruding diffuser-reflector portion 380. In this way, when the light generated by the light source 100 is reflected by the variable mirror 200, and thereafter, is introduced into the optical 300, the light reflected by the condenser-reflector portion 360 is condensed and moved, causing increased brightness in the central portion of beam scanning, and the light reflected by the diffuser-reflector portion 380 is diffused and moved to the edge portion of beam scanning, causing lower brightness in the edge portion than in the central portion. The condenser-reflector portion 360 and the diffuser-reflector portion 380 may be formed in the plane into which the light is introduced, and may be integrally connected to each other so as to achieve the smooth condensation and diffusion of the light.

Here, the optical 300, as illustrated in FIG. 6, may be formed so as to be concavely indented in the upper-and-lower direction. In addition to the convex shape of the diffuser-reflector portion 380 and the concave shape of the condenser-reflector portion 360 with respect to the left-and-right direction, when the entire optical 300 has a concave cross-section in the upper-and-lower direction, the light passing through the condenser-reflector portion 360 may be evenly condensed in the upper-and-lower direction. Thereby, the central portion of beam scanning achieves high brightness and the even emission of light in the upper-and-lower direction, and the edge portion of beam scanning exhibits lower brightness than the central portion.

Alternatively, as illustrated in FIG. 7, the optical 300 may be formed so that the center thereof is concavely indented and the upper and lower sides thereof convexly protrude in the upper-and-lower direction. As such, in addition to the concave shape of the diffuser-reflector portion 380 and the concave shape of the condenser-reflector portion 360 with respect to the left-and-right direction, when the optical 300 is concavely indented at the center thereof and convexly protrudes at the upper and lower sides thereof in the upper-and-lower direction, the light may be concentrated on the condenser-reflector portion 360 so as to be condensed. Thereby, light is concentrated on the central portion of beam scanning, causing higher brightness in the central portion than the edge portion of beam scanning, and causing light to be emitted at a lower brightness in the edge portion.

As described above, in the case where the optical 300 is configured to reflect light, the curved shape of the optical 300 in the upper-and-lower direction and in the left-and-right direction may be selectively changed by design.

Meanwhile, the light source 100 may be provided in a plural number, and may emit light toward the variable mirror 200 at different positions.

When the multiple light sources 100 emit light to the variable mirror 200 at different positions, the area to which light is emitted during beam scanning may be enlarged, and respective light emission areas may overlap each other, which may result in an increased quantity of light. In this way, high luminance intensity may be realized by a headlamp, which may result in a sufficient quantity of light and a sufficient width of light.

As is apparent from the above description, according to a light module for a vehicle having the structure described above, the speed at which a variable mirror vibrates is controlled, and an optical causes light to be concentrated in the central portion of beam scanning and to be diffused in the edge portion of beam scanning, whereby the central portion is brighter than the edge portion, resulting in increased luminance efficiency.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A light module for a vehicle comprising:

a light source generating light;

a variable mirror reflecting the light generated by the light source by repeatedly vibrating in an upper-and-lower direction and a left-and-right direction, for scanning of an image depending on the light generated by the light source; and an optical receiving the light reflected by the variable mirror, the optical having a continuously curved shape in the left-and-right direction for light introduced into a center of the optical to be condensed and moved and light introduced into a side of the optical to be diffused and moved, wherein, when the variable mirror vibrates in the left-and-right direction, the variable mirror vibration at a higher speed at a position at which the light reflected by the variable mirror is introduced to the side of the optical than at a position at which the light reflected by the variable mirror is introduced to the center of the optical.

2. The light module according to claim 1, wherein the variable mirror comprises a Micro Electro Mechanical System (MEMS) mirror disposed at a position, to which the light generated by the light source is introduced, to generate an image by varying an angle of reflection of the light.

3. The light module according to claim 1, wherein the optical includes:

a condenser lens portion centrally located in the left-and-right direction to condense and pass light therethrough; and a diffuser lens portion extending from the condenser lens portion to left and right sides to diffuse and pass light therethrough.

4. The light module according to claim 3, wherein the condenser lens portion of the optical is formed to convexly protrude, and the diffuser lens portion is formed to be concavely indented.

5. The light module according to claim 3, wherein the optical is formed to convexly protrude in the upper-and-lower direction.

6. The light module according to claim 3, wherein the optical is formed so that the center thereof convexly protrudes and upper and lower sides thereof are concavely indented in the upper-and-lower direction.

7. The light module according to claim 1, wherein the optical includes:

a condenser-reflector portion centrally located in the left-and-right direction to condense and reflect the light; and a diffuser-reflector portion extending from the condenser-reflector portion to left and right sides to diffuse and reflect the light.

8. The light module according to claim 7, wherein the condenser-reflector portion of the optical is formed to be concavely indented, and the diffuser-reflector portion is formed to convexly protrude.

9. The light module according to claim 7, wherein the optical is formed to be concavely indented in an upper-and-lower direction.

10. The light module according to claim 7, wherein the optical is formed so that the center of the optical is concavely indented and upper and lower sides thereof convexly protrude in an upper-and-lower direction.

11. The light module according to claim 1, further comprising a light-emitter provided at a position to which the light, condensed and diffused by the optical, is introduced for the introduced light to be emitted in a colored state.

12. The light module according to claim 1, wherein the light source comprises a plurality of light sources which emit light toward the variable mirror at different positions.

* * * * *